United States Patent [19]

Russell et al.

[11] 4,181,148

[45] Jan. 1, 1980

[54] SELF MONITORING DOUBLE VALVE

[75] Inventors: Neil E. Russell, Bloomfield Hills; Russell J. Cameron, Rochester, both of Mich.; Richard P. Zbell, Allison Park, Pa.; Lloyd L. Schmaltz, Clarkston, Mich.

[73] Assignee: Ross Operating Valve Company, Detroit, Mich.

[21] Appl. No.: 918,599

[22] Filed: Jun. 23, 1978

[51] Int. Cl.[2] ..... F15B 13/043; F15B 13/044

[52] U.S. Cl. ..... 137/596.16; 91/448; 137/596.17

[58] Field of Search ..... 91/424, 448; 137/596.16, 596.17

[56] References Cited

U.S. PATENT DOCUMENTS

| | | |
|---|---|---|
| Re. 28,520 | 8/1975 | Mahorney . |
| 2,906,246 | 9/1959 | Di Tirro et al. . |
| 3,757,818 | 9/1973 | Sweet . |
| 3,858,606 | 1/1975 | Cameron . |

*Primary Examiner*—Gerald A. Michalsky

*Attorney, Agent, or Firm*—Harness, Dickey & Pierce

[57] ABSTRACT

A double valve of the safety type for the control of equipment such as the clutch/brake of a press. The double valve comprises two four-way valves each having two supply and two working ports and an exhaust port. The valves are shiftable by fluid controlled means through a shuttle check valve. The arrangement is such that when either main valve is faulted, pressure will be removed from the clutch/brake motor and the fluid controlled shifting means will be disenabled due to the lack of synchronism between the main valves. This self monitoring function will prevent repressurization of the clutch/brake motor regardless of whether the unfaulted main valve continues to operate. The main valves are of the open center crossover type to prevent trapping of air at the working port for the clutch/brake motor in intermediate positions of the valves. The self monitoring function is accomplished by connecting both sides of the shuttle check valve, which supplies the fluid controlled shifting means, to exhaust whenever a discrepant main valve position exists, thus insuring that both main valves can no longer be simultaneously shifted to their open positions until the fault is cured. A lockout and reset valve is also shown between the outlet of the shuttle valve and the pilot valves, which further inhibits operation after the system is disenabled until there is a manual reset.

16 Claims, 16 Drawing Figures

SELF MONITORING DOUBLE VALVE

BACKGROUND OF THE INVENTION

1. Field of the Invention

The invention relates to double safety valves of the type used to control pneumatically actuated clutches and brakes for presses.

2. Description of the Prior Art

Several arrangements for these double valves are found in the prior art. One system, exemplified by Ditirro et al, U.S. Pat. No. 2,906,246, has two main valves in parallel to connect the supply port to the clutch/brake working port and the working port to the exhaust port. Discrepant positions between the main valves will inhibit pressurization of the clutch/brake line. Another basic arrangement has the main valve in series to accomplish the same purpose. A third arrangement is shown in Sweet, U.S. Pat. No. 3,757,818, Cameron, U.S. Pat. No. 3,858,606 and Mahorney, U.S. Pat. No. RE 28,520. This arrangement has the two main valves in series between the supply and working ports and in parallel between the working and exhaust ports.

In practice, the above described double safety valves are used in industry together with a monitoring arrangement which will sense, either by pressure differentials or limit switches, discrepant positions between the two main valves and will respond to such sensing to inhibit further operation of the system. The reason for the monitoring is that, under certain conditions, it is possible for the clutch/brake line to be partially controlled even after one of the main valves is stuck or otherwise faulted. Whether this occurs will depend to some extent on whether the faulted valve is stuck in its closed or open position. If in its closed or exhaust position, it is less likely for the remaining valve to continue to operate the system. If the stuck valve is in its open position, depending on the passageway dimensions and pressure differentials involved, it is possible in some cases to continue to operate the clutch/brake line with the remaining operable main valve. In this case, the operator may not become aware of the faulting of one or even both of the double valves unless a monitor is present.

BRIEF SUMMARY OF THE INVENTION

It is an object of the present invention to overcome the above described disadvantage of previous double safety valve systems and to provide a selfmonitoring double valve which inhibits further operation in the event either main valve is out of sequence with the other.

It is a further object to provide a double valve system of this character which eliminates the need for a separate monitoring arrangement and is of economical construction, requiring smaller part sizes than previous systems.

Briefly, the invention comprises a double safety valve having two main valves, shifting means for said main valves, a fluid control line for said shifting means, a shuttle check valve having a pair of inlet ports and an outlet port leading from between said inlet ports and interconnected with said control line, whereby said control line is pressurized in response to pressurizing either one or both of said inlet ports and exhausted in response to exhausting of both inlet ports, a working port connectable to a unit to be controlled by said double valve, a pressurized fluid supply port leading to one of said main valves, and exhaust ports leading from both of said main valves, the main valves being movable in synchronism between a first position in which said supply port is connected to one of said shuttle check valve inlet ports and said working port is connected to one of said exhaust ports, and a second position in which said supply port is connected to the other shuttle check valve inlet port and said working port, said main valves having ports so arranged that when either main valve is in said first position and the other is in said second position, said working port and both shuttle check valve inlet ports will be connected to said exhaust ports, said shifting means being responsive to exhausting of said control line to urge both main valves toward said first position.

DESCRIPTION OF THE PREFERRED EMBODIMENTS

The double valve of this invention is generally indicated at 11 and comprises two main valves generally indicated at 12 and 13. Each valve 12 and 13 comprises a two position valve having two supply ports, two working ports and an exhaust port. The two supply ports for valve 12 are indicated at 14 and 15, the two working ports at 16 and 17 and the exhaust port at 18. In valve 13, the two supply ports are indicated at 19 and 21, the two working ports at 22 and 23 and the exhaust port at 24.

Figure 1:
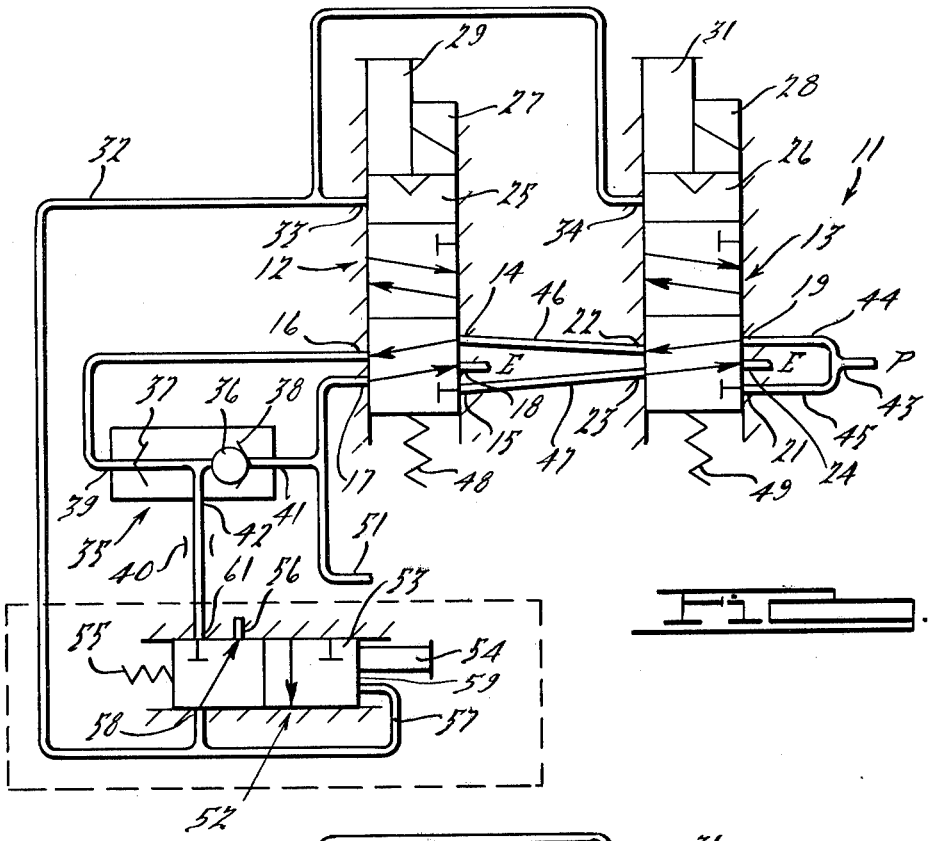
FIG. 1 is a diagrammatic view of a first embodiment of the invention using normally closed pilot valves, showing the main valves in their first position with the lockout and reset valve being in its exhaust position.
Figure 2:
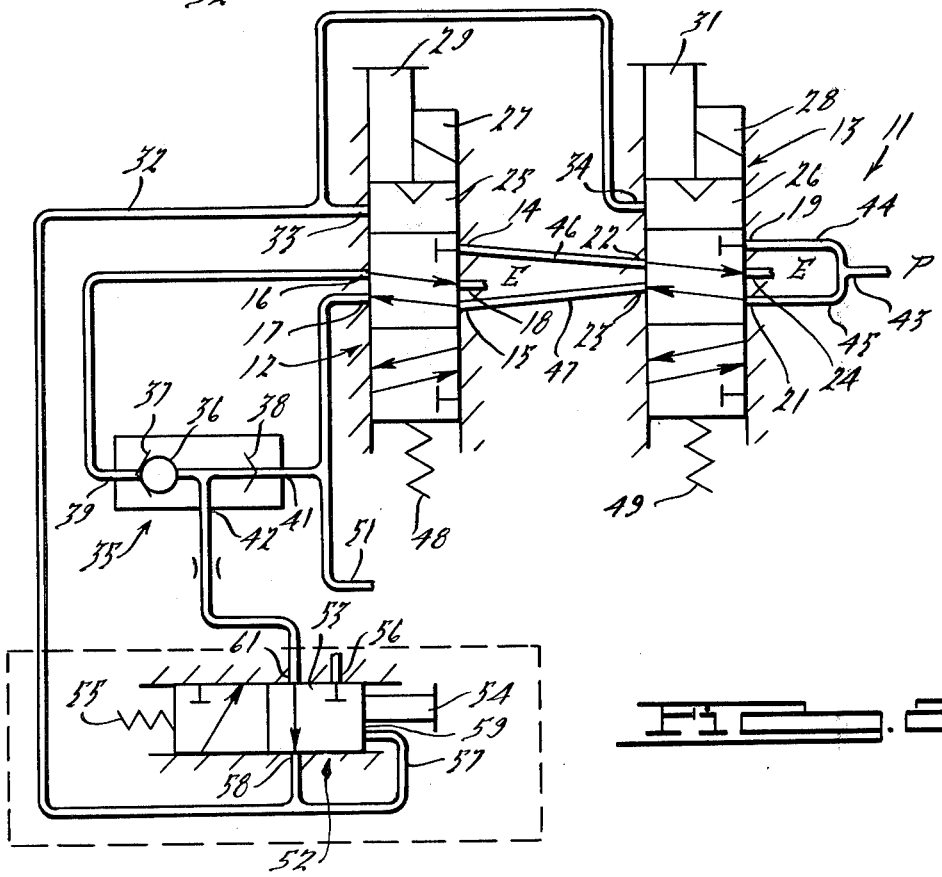
FIG. 2 is a view showing the main valves in their second position with the lockout and reset valve in its open position.

Valves 12 and 13 are suitably constructed in the form of spool valves although they may also be constructed as poppet valves. Both valves are shiftable between first or upper position as shown in FIG. 1 and a second or lower position as shown in FIG. 2. The shifting means is indicated at 25 and 26 respectively for the two valves and comprises a normally closed pilot valve which is shiftable to its open position when a solenoid 27 or 28 is energized to pressurize a normally exhausted piston chamber for the main valve. Manual means 29 and 31 are also provided for moving the two valves from their upper to their lower positions. The two pilot valves are supplied by a compressed air line 32 leading to inlet ports 33 and 34. Line 32 acts as a control line for the main valve shifting means, as will become apparent below.

A shuttle check valve generally indicated at 35 is provided, this valve having a movable member 36 which may be seated on a first valve seat 37 at one end of the shuttle or a second valve seat 38 at the other end. Member 36 may also be in a position between these two seats. Valve 35 is provided with a first inlet port 39 adjacent seat 37, a second inlet port 41 adjacent seat 38 and an outlet port 42 leading from between said inlet ports. Port 39 is connected to port 16 of valve 12 and port 41 to port 17 of valve 12. Port 42 is connected to control line 32 of the pilot valves 25 and 26. The control line is preferably provided with a restriction 40 to desensitize the line with respect to momentary pressure fluctuations during operation.

A source of compressed air 43 is provided, this source being connected by two lines 44 and 45 to ports 19 and 21 respectively of valve 13. A line 46 is provided which connects port 22 of valve 13 with port 14 of valve 12. A second line 47 connects port 23 of valve 13 with port 15 of valve 12.

The main valve shifting means also comprises a pair of springs 48 and 49 or equivalent means for valves 12 and 13 respectively which constantly urge these valves toward their upper positions. In these positions, as shown in FIG. 1, valve 13 connects port 19 with port 22 and port 23 with exhaust port 24. Valve 12 connects port 14 with port 16 and port 17 with exhaust port 18. Port 21 of valve 13 is blocked as is port 15 of valve 12. Port 17 of valve 12 is connected to a working port 51 which leads to the clutch/brake motor of the press or to another unit which is to be controlled by the assembly. The clutch/brake construction is usually such that when pressure is applied to port 51 the clutch will be engaged and the brake disengaged, whereas exhausting of port 51 will apply the brake and release the clutch to stop the press.

The lockout and reset valve is generally indicated at 52 and comprises a three way normally closed valve 53 which is manually resettable toward a left hand position and spring urged to its right hand position as shown in FIG. 1. The manual reset means is indicated at 54 and the spring at 55. It should be understood that in the case of all valves 12, 13 and 53 the spring could be replaced by constant pressure. Valve 52 is placed in control line 32 between port 42 and the pilot supply ports 33 and 34. In its right hand position as shown in FIG. 1 the pilot ports 33 and 34 will be connected to an exhaust port 56 whereas in the left hand position, port 42 will be connected to ports 33 and 34. A line 57 is provided from working port 58 of valve 53 to a holding chamber 59 so that when the valve is manually reset the pressure is supplied from port 61 to port 58 the valve will be held in its reset position as long as the pressure is available.

In operation, assuming an initial position of the parts as shown in FIG. 1, with solenoids 27 and 28 deenergized, working port 51 will be connected to exhaust port 18. Supply port 19 will be connected through port 22, line 46, ports 14 and 16 and shuttle check valve ports 39 and 42 to port 61 of lockout and reset valve 52. Upon manual resetting of this lockout and reset valve, port 61 will be connected to port 58 and thence to line 32 leading to ports 33 and 34 of pilot valves 25 and 26. Valve member 36 of the shuttle check valve will at this time be seated against valve seat 38 to prevent any pressurized air from reaching working port 51 which will remain exhausted. Lockout and reset valve 52 will be held in its left hand position by pressure supplied to chamber 59. The air pressure at ports 33 and 34 will be ineffective to shift valves 12 and 13 to their lower positions until solenoids 27 and 28 are energized, since air pilot valves 25 and 26 are normally closed valves.

In normal operation, solenoids 27 and 28 will be simultaneously energized to shift air pilot valves 25 and 26 to their open positions. This will shift valves 12 and 13 downwardly to their FIG. 2 positions. Air from supply source 43 will now be supplied to working port 51 through ports 21 and 23 of valve 13, line 47, and ports 15 and 17 of valve 12. Port 39 of the shuttle check valve will be connected to exhaust port 18 of valve 12. However, port 41 of the shuttle check valve will be supplied from port 17 of valve 12 so that line 32 and therefore supply ports 33 and 34 of the pilot valves will remain pressurized. Member 36 of the shuttle will engage valve seat 37 to prevent exhausting of the pilot valves. Upon deenergization of solenoids 27 and 28, main valves 12 and 13 will return to their FIG. 1 positions.

With respect to lockout and reset valve 52, it should be noted that this valve will remain in its left hand position as shown in FIG. 2 as long as the two main valves are moving synchronously. This is because port 42 of the shuttle check valve will remain pressurized as valves 12 and 13 shift together between their FIG. 1 and FIG. 2 positions. When the two main valves return to their FIG. 1 position the lockout and reset valve will still remain in its left hand position and pressure will still be applied to chamber 59.

Figure 3:
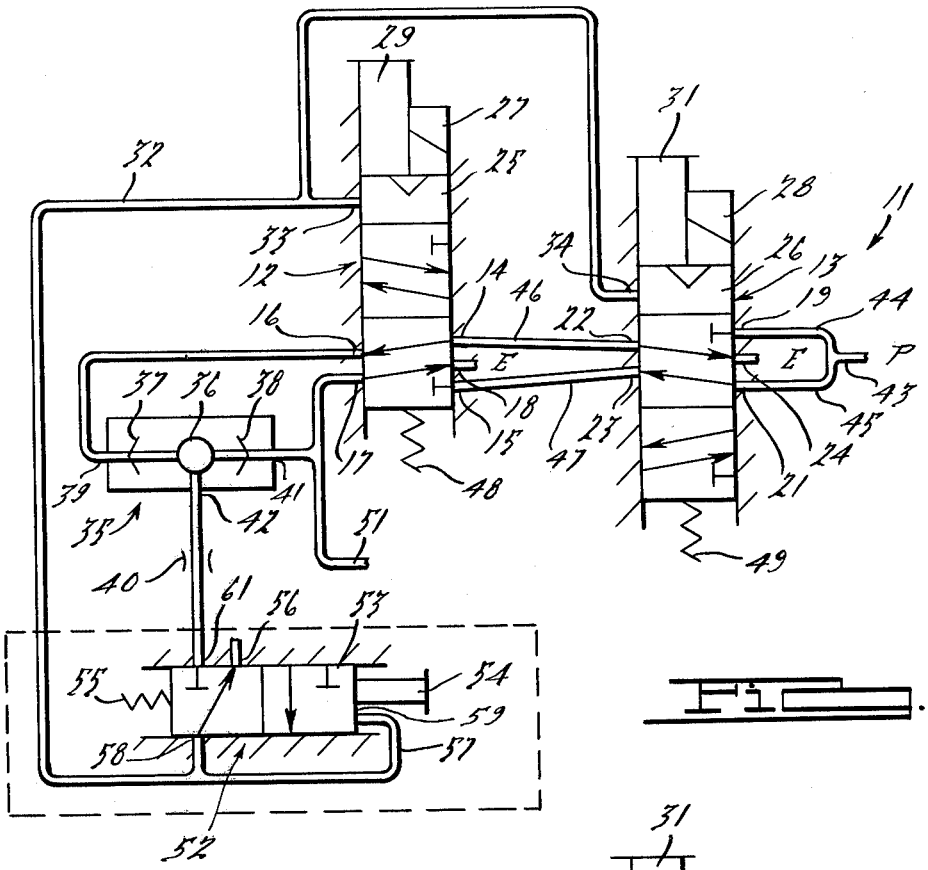
FIG. 3 is a view showing the main valves in discrepant positions with one main valve being in its first and the other in its second position.

FIG. 3 illustrates the result of a discrepant position between the two main valves, in this case valve 12 being in its deenergized position and valve 13 in its energized position. The cause of such asynchronism could be that either valve 12 or 13 is faulted or stuck. When this happens, pressure will be blocked to working port 51 since port 19 is blocked by valve 13 and port 21 is connected through port 23 of valve 13 and line 47 to port 15 of valve 12 which is blocked. At the same time, port 17 will be connected to exhaust port 18. Working port 51 will thus be exhausted to stop the press.

Both ports 39 and 41 of shuttle check valve 35 will be connected to exhaust. In the case of port 41 this connection will be through ports 17 and 18 of valve 12, whereas in the case of port 39 the connection will be from port 16 to port 14 of valve 12 through line 46 and port 22 of valve 13 to exhaust port 24 of this valve.

Shuttle check valve 35 will thus be in a neutral position, that is, valve member 36 will be seated neither on seat 37 nor 38. As a result, supply ports 33 and 34 of air pilots 25 and 26 respectively will be connected through port 42 of shuttle check valve 35 to exhaust.

In the event that lockout and reset valve 52 is in the circuit, ports 33 and 34 will not be exhausted through the above described ports 18 and 24 but through port 56 of the lockout and reset valve. This is because the exhausting of chamber 59 through the shuttle check valve will cause spring 55 to return the lockout and reset valve to its right hand position.

Should valve 13 be faulted or stuck in its lower position in FIG. 3, there will be no further movement of the valves regardless of energization or deenergization of the two solenoids. If on the other hand valve 12 is stuck in its raised position but valve 13 is free to move, spring 49 will return valve 13 to its upper position as soon as pressure is exhausted from port 34. This will cause pressure to be resupplied to port 39 of shuttle check valve 35 as in FIG. 1. If no lockout and reset valve is present in the circuit, the result will be pressure applied to port 34 and, as long as solenoid 28 remains energized, valve 13 will move up and down. However, there will be no pressure applied to working port 51 which will remain exhausted. With lockout and reset valve 52 in the circuit, once this valve shifts to its right hand or exhaust position ports 33 and 34 will both remain depressurized regardless of energization of solenoids 27 and 28.

Figure 4:
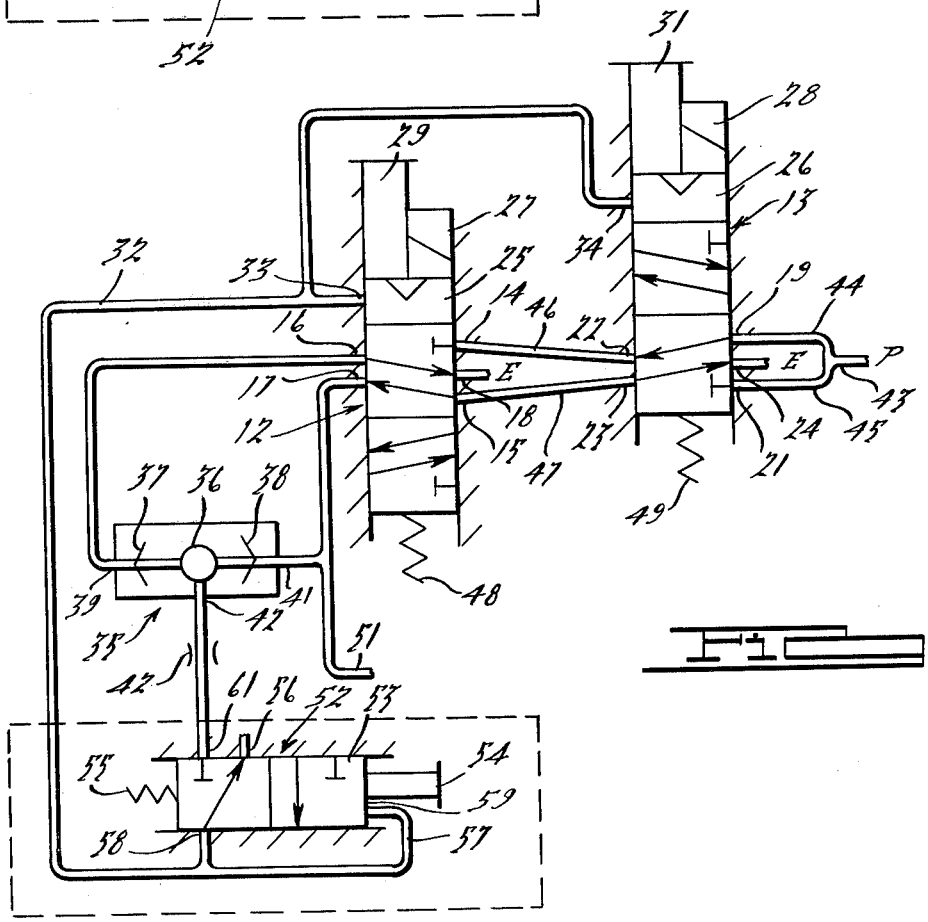
FIG. 4 is a view showing the opposite type of discrepant position.

FIG. 4 shows a condition where the valves are asynchronous with valve 12 being in its lower position and valve 13 in its upper position. This could be because either valve is stuck or faulted. Here we see that air pressure will be cut off from working port 51 and this port will be connected to exhaust port 24 of valve 13 through ports 17 and 15 of valve 12, line 47 and port 23 of valve 13. This connection will also exhaust port 41 of shuttle check valve 35. Port 39 of this valve will be exhausted through ports 16 and 18 of valve 12. Valve member 36 will be in a neutral position, exhausting chamber 59 of lockout and reset valve 52. This valve will move to its right hand position, exhausting ports 33 and 34 of air pilots 25 and 26. As in the case of FIG. 3, there will be no further pressurization of port 51 until the main valves 12 and 13 are returned to synchronism and valve 52 is reset.

It is thus seen that the double valve system of this invention eliminates the need for a separate monitoring device such as was desirable in the systems of the above mentioned patents. Instead, the fact that both end ports 39 and 41 of shuttle check valve 35 are connected to exhaust if there is a discrepant position between the two main valves insures that the pilot supply ports will be depressurized and that working port 51 will remain connected to exhaust.

FIGS. 5 through 8 are intended to show the results of either valve 12 or 13 being faulted or stuck in an intermediate position. The symbols shown for valves 12 and 13 are not intended to illustrate the actual construction of the valves, in the sense that the valves are not three position valves but two position valves. The center position, indicated at 62 for valve 12 and 63 for valve 13, is merely intended to illustrate the transitory crossover state as the valves shift from one position to the other. The valve elements are constructed in a conventional manner, so that during this crossover movement both working ports 16 and 17 of valve 12 will be connected to exhaust port 18 and both working ports 22 and 23 of valve 13 will be connected to exhaust port 24. These diagrams thus demonstrate that pressure is directed to the clutch/brake port 51 when and only when both valves 12 and 13 are in their full normal energized mode as shown in FIG. 2. In all seven other modes (FIGS. 1 and 3 through 8) port 51 will be exhausted. An additional mode, when both main valves are in a crossover state at the same time, has not been illustrated, but will obviously have the same result, with port 51 connected to exhaust.

Figure 5:
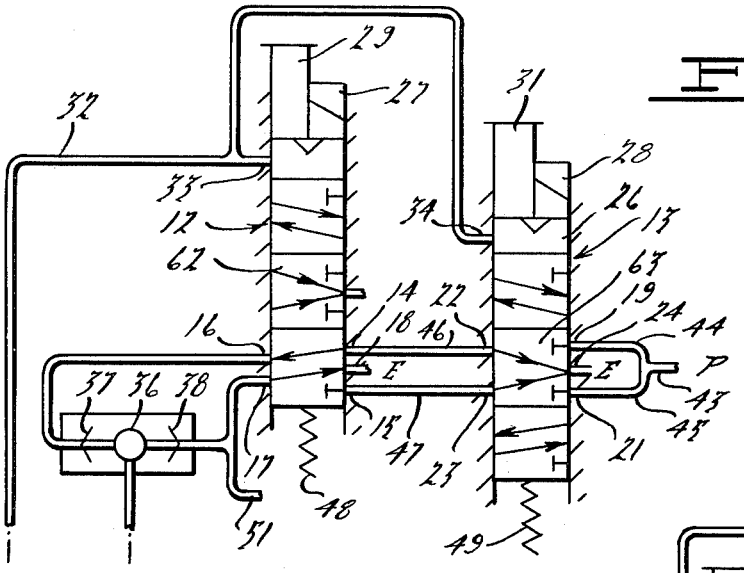
FIGS. 5 through 8 illustrate intermediate positions of the valves to demonstrate that the open crossover nature results in both working ports being connected to exhaust.
Figure 6:
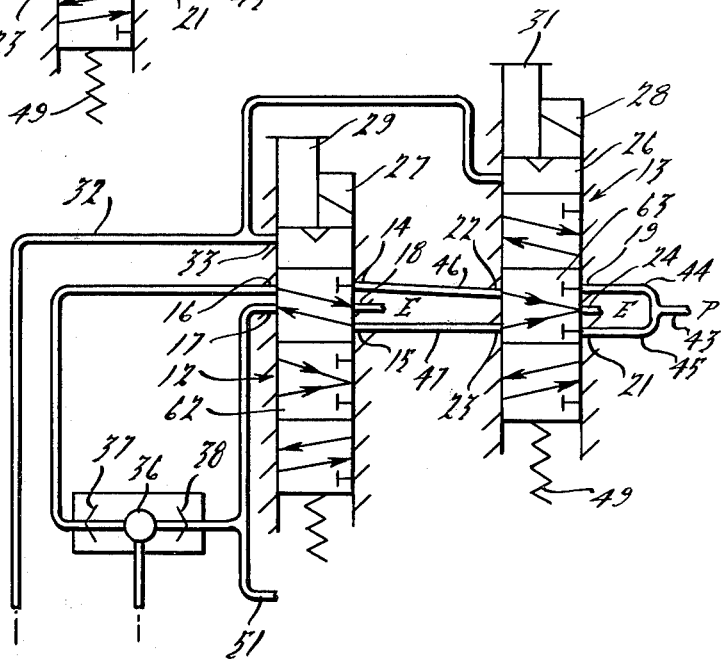
Figure 7:
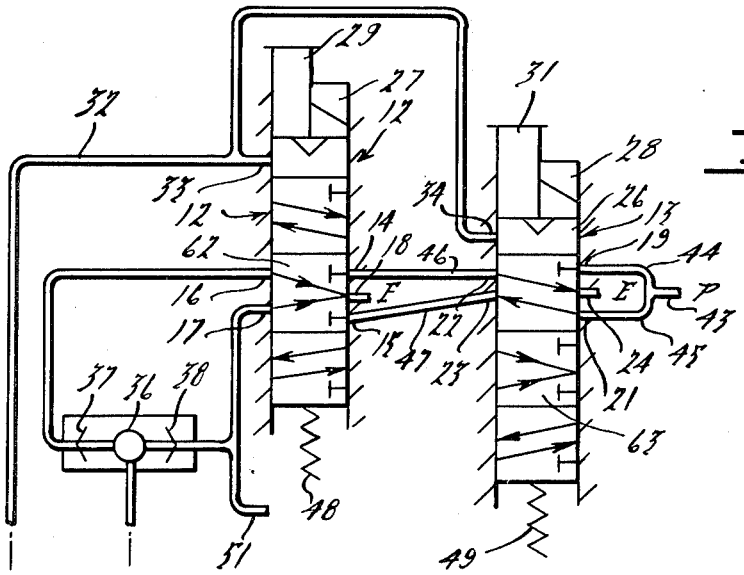
Figure 8:
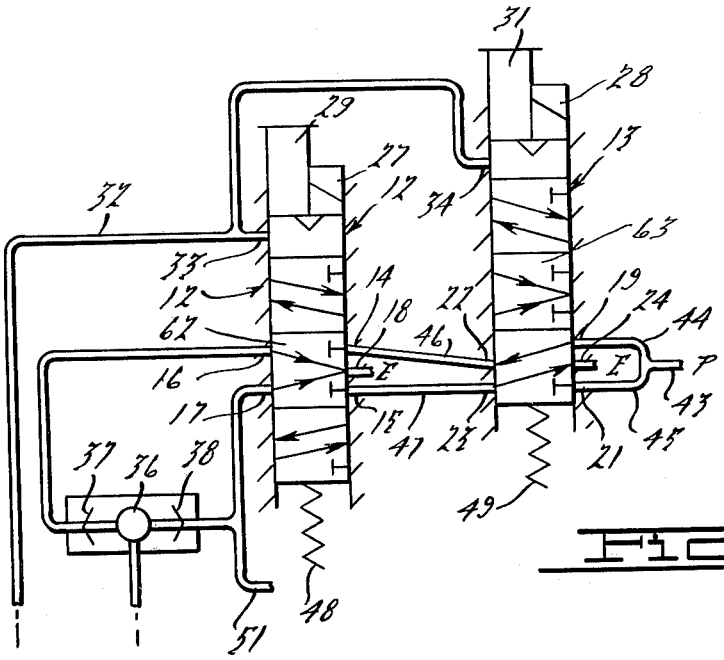

Describing FIGS. 5 through 8 with more particularity, FIG. 5 shows a condition where valve 13 is in a crossover state with valve 12 deenergized. FIG. 6 shows valve 13 in a crossover state with valve 12 energized. In FIGS. 7 and 8, valve 12 is shown in a transitory crossover position, with valve 13 in an energized position in FIG. 7 and a deenergized position in FIG. 8.

Figure 9:
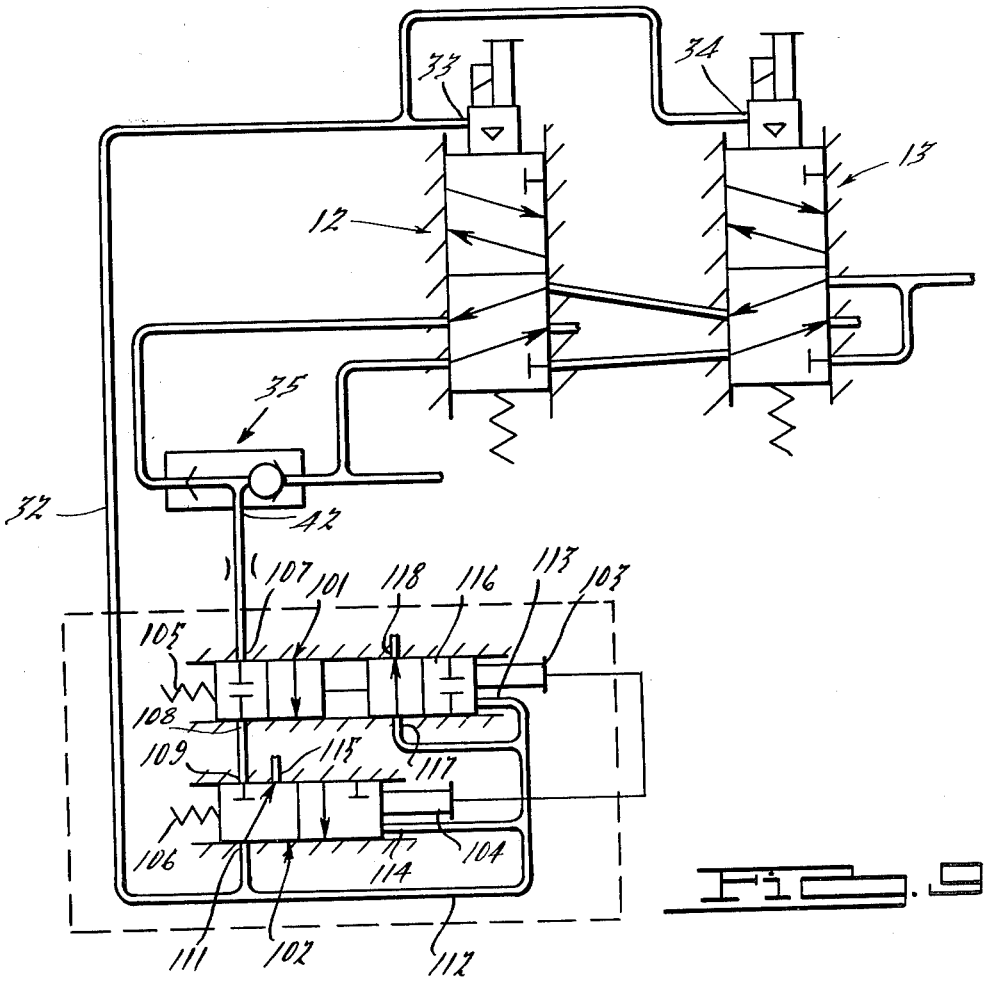
FIG. 9 is a view similar to FIG. 1 showing a modified form of the lockout and reset valve.

FIG. 9 illustrates a modified version of the lockout and reset valve which differs from that in the other figures in that it has a redundant feature, namely a duality of valves which are indicated generally at 101 and 102. Both of these valves have a manual reset feature 103 and 104 respectively and are urged in the opposite direction by springs 105 and 106. Two way valve 101 has a port 107 which, like port 61 of valve 52, would be connected to shuttle valve port 42. The other port 108 of valve 101 is connected to a port 109 of valve 102. A port 111 of valve 102 is connected to line 32 similarly to port 58 of valve 52. This port 111 is also connected by a line 112 to a pair of holding chambers 113 and 114 of valves 101 and 102 respectively which when pressurized will hold their valves in the left hand position.

When in this position, ports 107 and 108 are connected as are ports 109 and 111. Thus, when valves 101 and 102 are reset and valves 12 and 13 are moving synchronously, the air pilot supply ports 33 and 34 would be continuously supplied with air pressure as in the first embodiment. However, should a discrepant position appear between the two main valves, exhausting of port 42 will result in valves 101 and 102 being shifted to their right hand position. This would cut off the air supply to line 32 and connect this line, as well as chambers 113 and 114, to exhaust port 115 of valve 102. Additionally, valve 101 is provided with a portion 116 having ports 117 and 118, the latter being connected to exhaust. In the left hand position of valve portion 116 these two ports are blocked but in the right hand position port 117 will be connected to exhaust port 118. Line 112 is connected to port 117 so that this would be an additional path of exhaust for air pilot ports 33 and 34 as well as chambers 113 and 114. The advantage of this redundance is that failure of one of the two valves 101 or 102, for example by impairment of springs 105 or 106, would not prevent the full lockout and reset functions from being present.

Figure 10:
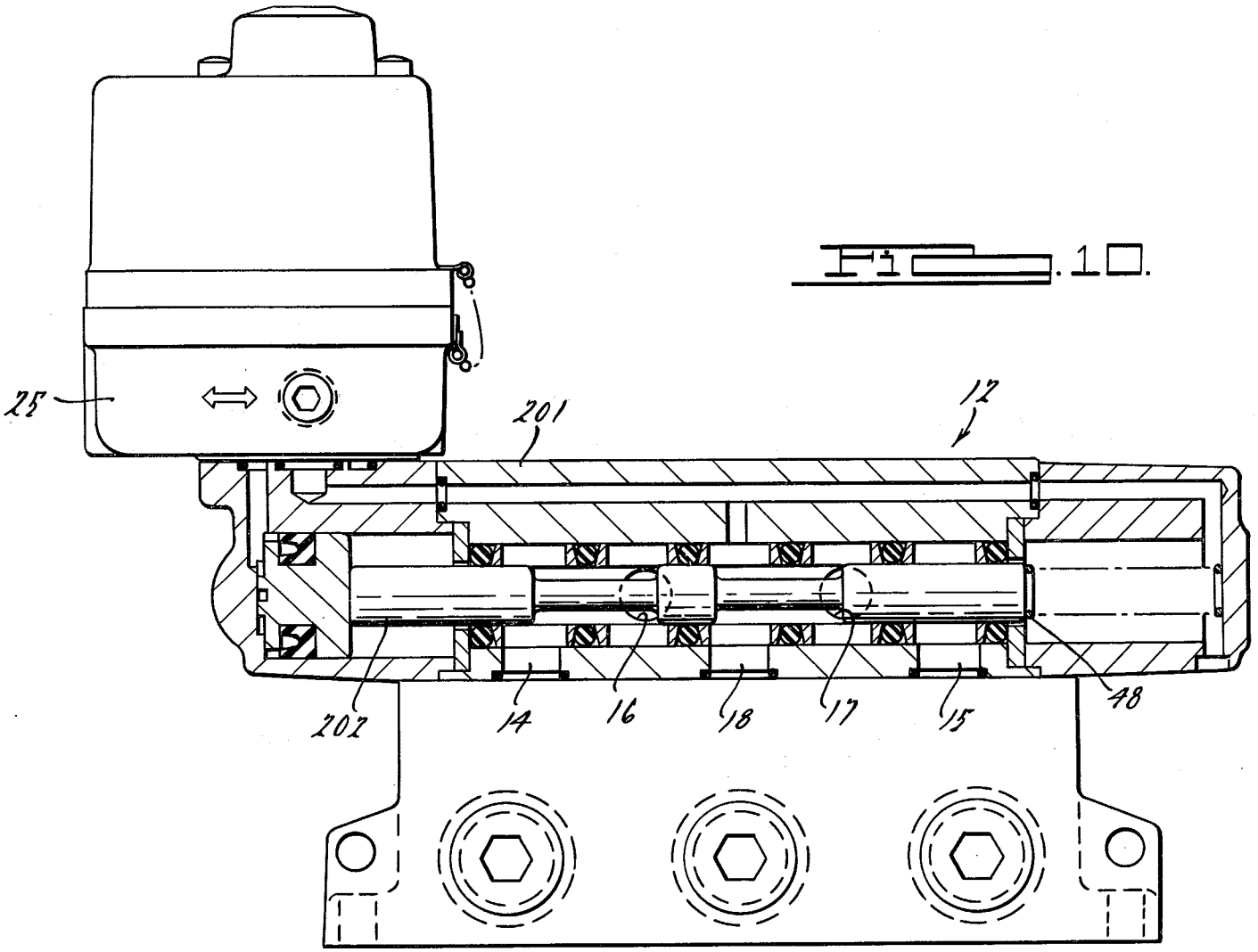
FIG. 10 is a cross-sectional view of a spool valve suitable for use in this invention.

FIG. 10 shows a spool valve, indicated at 12, which is suitable for use as each of the double valves 12 and 13. The valve body is indicated at 201 and encloses a spool 202 having a piston at one end actuatable by shifting means 25 and a spring 48 at the other end. The construction is such that, in intermediate positions of spool 202, both working ports 16 and 17 will be connected to exhaust port 18, thus achieving an open center crossover condition.

Figure 11:
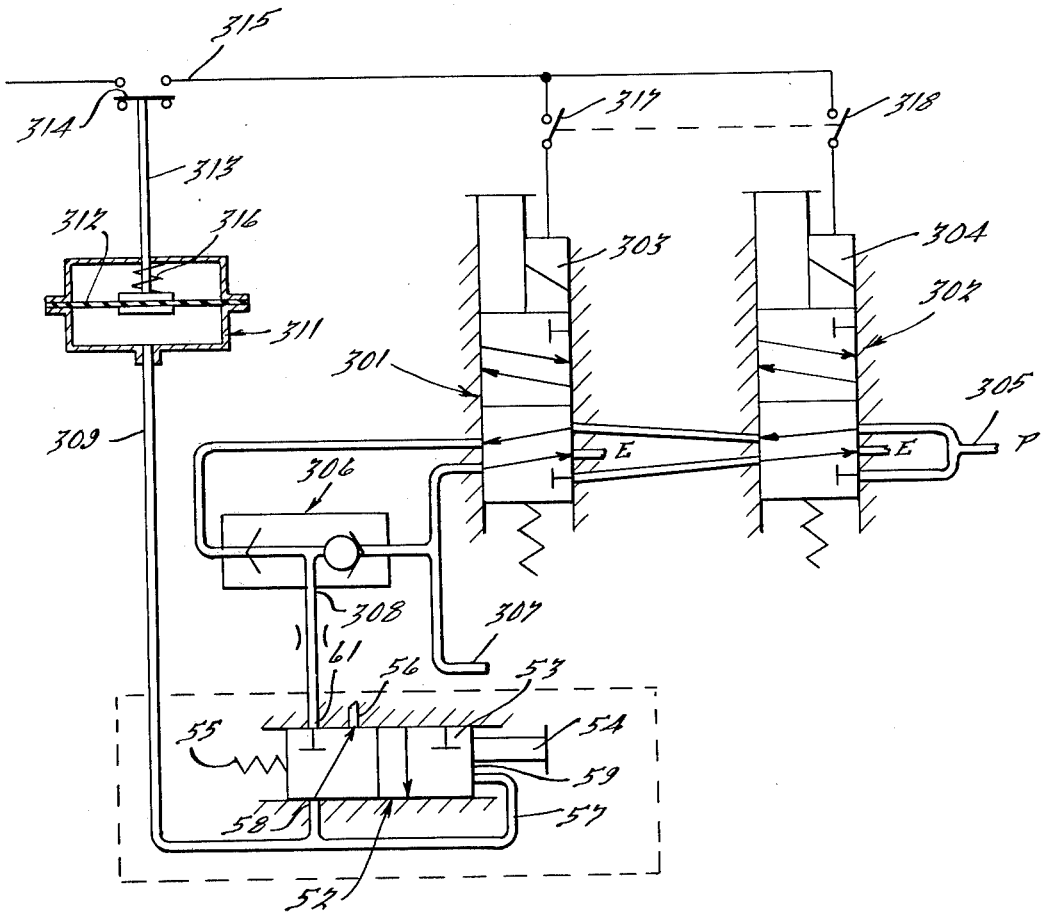
FIG. 11 is a diagrammatic view of a modified form of the invention utilizing direct solenoid operated main valves controlled by a pressure-responsive switch.
Figure 12:
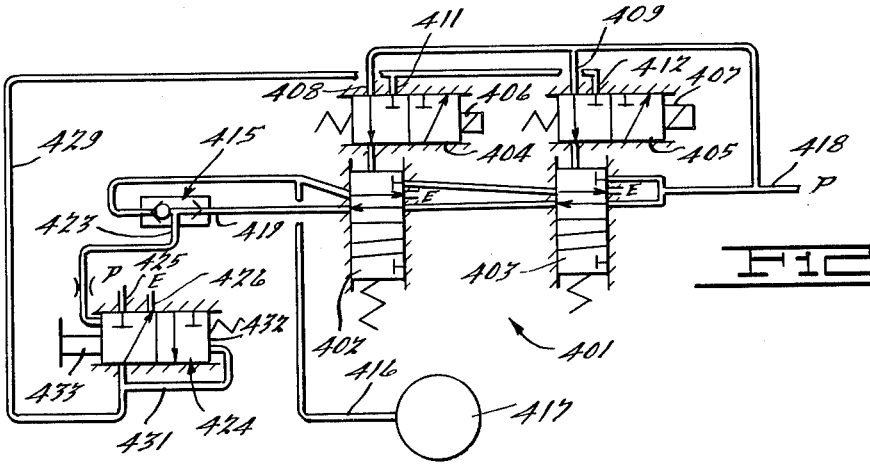
FIG. 12 is still another embodiment of the invention using normally open pilot valves, the main valves being in their first position.
Figure 13:
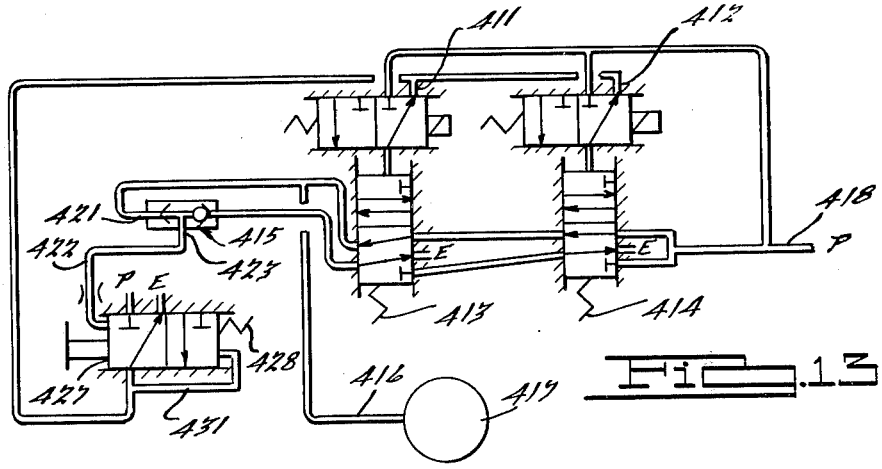
FIG. 13 is a view similar to FIG. 12 but showing the main valves in their second position.
Figure 14:
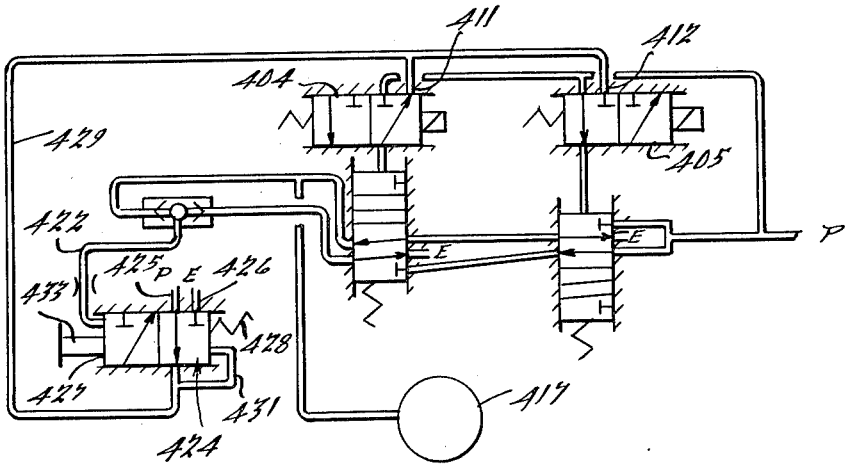
FIG. 14 shows one main valve faulted, with the interlock portion of the shifting means moved so as to urge both main valves toward their first position.
Figure 15:
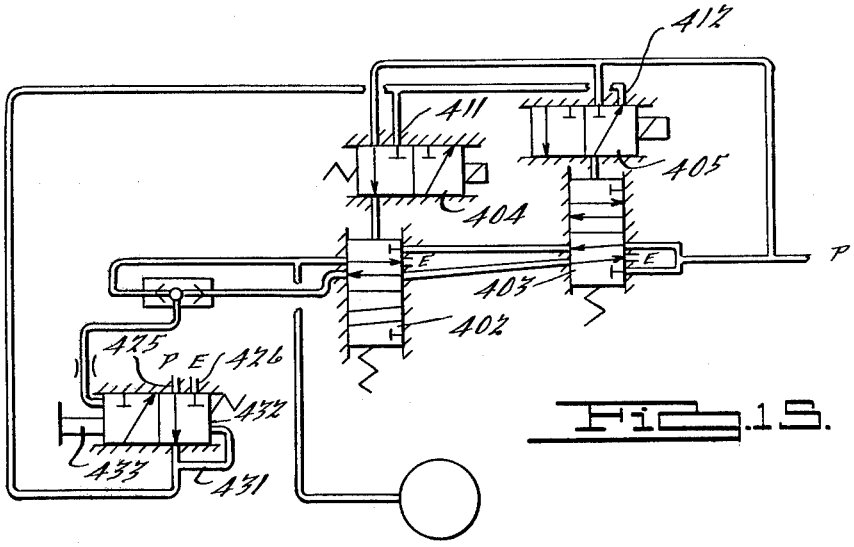
FIG. 15 shows what happens when the other main valve is faulted.
Figure 16:
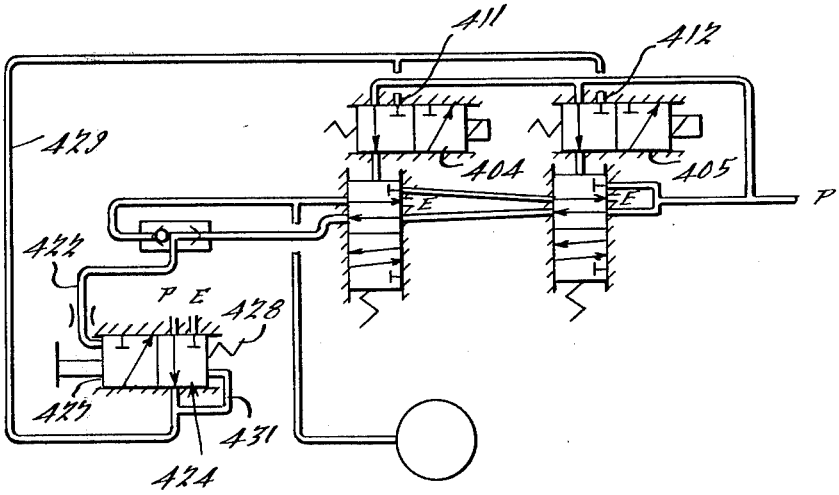
FIG. 16 shows why it is necessary to manually reset the interlock when both main valves return to synchronism.

FIG. 11 shows a modified form of the invention in which the fluid controlled shifting means for the main valves comprises a pressure-operated switch which controls an electrical supply line to solenoids for the main valves. These are generally indicated at 301 and 302 and are directly shiftable by solenoids 303 and 304, instead of pilot valves. As long as main valves 301 and 302 move synchronously, electrical power will be supplied to solenoids 303 and 304 which are controlled by switches 317 and 318. However, should a discrepant position occur between the two main valves, pressure will be blocked both to working port 307 and shuttle check valve 306, and exhaustion of control line 309 will disenable the solenoid power supply.

FIGS. 12 to 16 show still another embodiment of the invention which utilizes normally open pilot valves. The double valve is generally indicated at 401 and comprises two main valves 402 and 403, together with a shuttle check valve. Pilot valves 404 and 405 are of the normally open type; that is, when their solenoids 406 and 407 are de-energized, the pilots connect internal supply lines 408 and 409 to the piston chambers of valves 402 and 403, holding these valves in their first position which in this case is the lower position shown in FIG. 12. When the solenoids are energized, the pilot valves will be shifted to block supply lines 408 and 409, and connect the main valve piston chambers to exhaust ports 411 and 412. This will permit springs 413 and 414 to shift the main valves to their second or upper position, shown in FIG. 13.

The porting of main valves 402 and 403 is similar to that of the previous embodiments, and a shuttle check valve generally indicated at 415 is provided, as well as a working port 416 leading to the clutch-brake motor 417 of the press. The connections are such that when the main valves are in their lower position, supply port 418 will be connected to shuttle check valve inlet port 419 and working port 416 will be connected to exhaust. When the main valves are shifted in synchronism to their upper position, supply port 418 will be connected both to inlet port 421 of the shuttle check valve and to working port 416.

The fluid control line for the main valve shifting means in FIGS. 12 to 16 is designated at 422 and is interconnected with outlet port 423 of shuttle check valve 415. In addition to the pilot valves and springs, the main valve shifting means in FIG. 12 also comprises an interlock valve generally indicated at 424. This valve has a constant pressure supply port 425 and an exhaust port 426. It is shiftable between a right hand position shown in FIG. 12, in which exhaust ports 411 and 412 of the pilot valves are connected to exhaust port 426, and a left hand position (FIGS. 14, 15 and 16) in which ports 411 and 412 are connected to supply port 425. When this occurs, the main valve shifting means, particularly pilot valves 404 and 405, will, regardless of their position, admit air to the piston chambers of the main valves urging them toward their first or lower position.

The position of interlock valve 424 is affected by control line 422 which is connected to a piston chamber 427 at the left hand end of the valve, a spring 428 at the right hand end urging the valve to the left. Pressure in control line 422 will thus permit the main valve shifting means to move the main valves in synchronism between their FIG. 12 and FIG. 13 positions, as long as interlock valve 424 is in its right hand position, whereas exhausting of the control line will cause the shifting means to urge both main valves toward their first or lower position.

A line 429 connects interlock valve 424 with pilot valve exhaust ports 411 and 412. In order to insure that, after interlock valve 424 has shifted to its left hand or safety position, it cannot be inadvertently reset (shifted back to its right hand position) after control line 422 is re-pressurized, a bypass line 431 is provided, leading from line 429 to a piston chamber 432 on the right hand side of valve 424. Chamber 432 has the same effective area as chamber 427 at the opposite end of the valve. A manual reset 433 is provided for valve 424 at its left hand end, to counteract spring 428 and return the valve after control line 422 has been repressurized, to return the ports from their FIG. 16 to their FIG. 12 position.

In operation of the embodiment of FIGS. 12 to 16, as long as the main valves move in synchronism, interlock valve 424 will be held in its right hand position and working port 416 will be exhausted when the solenoids are de-energized (FIG. 12) with the main valves in their lower position, and pressurized when the solenoids are energized (FIG. 13) and the main valves raised. Failure of either main valve, and the resultant discrepant position between the valves (FIGS. 14 and 15) will connect both shuttle check valve inlet ports 419 and 421, as well as working port 416, to exhaust, thus exhausting control line 422 as well. Interlock valve 424 will shift to the left, providing constant pressure to ports 411 and 412 so as to urge the main valves downwardly to prevent them from further upward shifting. Upon correction of the main valve difficulties, the ports will return to their FIG. 16 position so that interlock valve 424 may be manually reset.

While it will be apparent that the preferred embodiments of this invention disclosed are well calculated to fulfill the objects above stated, it will be appreciated that the invention is susceptible to modification, variation and change without departing from the proper scope or fair meaning of the subjoined claims.

We claim:

1. A double safety valve comprising two main valves, shifting means for said main valves, a fluid control line for said shifting means, a shuttle check valve having a pair of inlet ports and an outlet port leading from between said inlet ports and interconnected with said control line, whereby said control line is pressurized in response to pressurizing of either one or both of said inlet ports and exhausted in response to exhausting of both inlet ports, a working port connectable to a unit to be controlled by said double valve, a pressurized fluid supply port leading to one of said main valves, and exhaust ports leading from both of said main valves, the main valves being movable in synchronism between a first position in which said supply port is connected to one of said shuttle check valve inlet ports and said working port is connected to one of said exhaust ports, and a second position in which said supply port is connected to the other shuttle check valve inlet port and said working port, said main valves having ports so arranged that when either main valve is in said first position and the other is in said second position, said working port and both shuttle check valve inlet ports will be connected to said exhaust ports, said shifting means being responsive to exhausting of said control line to urge both main valves toward said first position.

2. The combination according to claim 1, said main valves also being constructed so that when either valve is in an intermediate position and the other valve is in either said first or said second position said shuttle check valve inlet ports and said working port will be connected to said exhaust ports.

3. The combination according to claim 1, said main valves being of the open crossover type.

4. The combination according to claim 1, said main valves comprising spool valves.

5. The combination according to claim 1, each main valve being provided with two supply ports, two working ports and one of said exhaust ports, said pressurized fluid supply port being connected to the two supply ports of one of said main valves.

6. The combination according to claim 1, said main valve shifting means comprising pilot valves for said main valves.

7. The combination according to claim 6, said pilot valves being normally closed.

8. The combination according to claims 1 or 7, further provided with lockout and reset valve means disposed between the outlet port of said shuttle check valve and said shifting means control line, manual means for shifting said lockout and reset valve means to a first position in which the outlet port of said shuttle check valve is connected to said shifting means control line, means responsive to said manual shifting to hold said lockout and reset valve in said first position by fluid pressure supplied from the outlet port of said shuttle check valve, and means constantly urging said lockout and reset valve means to a second position, responsive to loss of pressure at said shuttle check valve outlet port, in which said shuttle check valve outlet port is disconnected from said shifting means control line and from said lockout and reset valve holding means.

9. The combination according to claim 8, said lockout and reset valve means comprising a three way normally closed valve.

10. The combination according to claim 8, said lockout and reset valve means comprising first and second valves in series, the first valve being a two way valve movable between an open first position and a blocked second position, the second valve being downstream of the first valve, having an outlet port connected to said shifting means control line, and being movable between an open first position and a second position exhausting said shifting means control line, reset valve holding means for both of said lockout and reset valves connected to the outlet port of said second valve, and means connected to said first lockout and reset valve movable between a first position blocking exhaust from said holding means when said first valve is in its first position and a second position exhausting said holding means independently of said second valve when said first valve is in its second position.

11. The combination according to claim 6, said pilot valves being normally open and having supply and exhaust ports, said main valve shifting means including means for applying constant pressure to said pilot valve exhaust ports in response to exhausting of said control line.

12. The combination according to claim 11, said last mentioned means comprising an interlock valve movable between a first position in which it is maintained by pressurizing of said control line, to connect said pilot valve exhaust ports to exhaust, and a second position in response to exhausting of said control line to apply said constant pressure.

13. The combination according to claim 12, further provided with means for pressurizing the end of said interlock valve opposite said control line, the two ends of said interlock valves having equal areas, a spring aiding said last mentioned pressurizing means whereby said interlock valve will not be automatically reset in response to loss and recovery of control line pressure, and manual reset means for said interlock valve.

14. The combination according to claim 1, said main valve shifting means comprising solenoids, an electrical power line for said solenoids, and a fluid pressure operated switch in said power line and connected to said shifting means control line.

15. The combination according to claim 14, said switch being so arranged as to open said power line in response to exhausting of said control line.

16. The combination according to claim 14 or 15, said solenoids operating said main valves directly.

* * * * *